US007212770B2

(12) United States Patent
Konishi

(10) Patent No.: US 7,212,770 B2
(45) Date of Patent: May 1, 2007

(54) PHOTOCONDUCTIVE DRUM DEVICE

(75) Inventor: Takashi Konishi, Nagaokakyo (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 134 days.

(21) Appl. No.: 11/077,489

(22) Filed: Mar. 8, 2005

(65) Prior Publication Data

US 2005/0201777 A1 Sep. 15, 2005

(30) Foreign Application Priority Data

Mar. 11, 2004 (JP) ..... 2004-069349

(51) Int. Cl.
*G03G 21/18* (2006.01)
*G03G 21/16* (2006.01)

(52) U.S. Cl. ..... 399/114; 399/111

(58) Field of Classification Search ..... 399/111, 399/113, 114

See application file for complete search history.

(56) References Cited

U.S. PATENT DOCUMENTS 6,968,142 B2 * 11/2005 Arimitsu et al. ..... 399/114

FOREIGN PATENT DOCUMENTS

JP 06-317963 11/1994
JP 2000-132068 5/2000

* cited by examiner

*Primary Examiner*—Hoang Ngo
(74) *Attorney, Agent, or Firm*—Hogan & Hartson LLP

(57) ABSTRACT

A photoconductive drum device is inserted into and removed from an image forming device main body, horizontally from a side of the image forming device main body. The photoconductive drum device includes a frame, a photoconductive drum and a cover. The photoconductive drum is supported rotatably on the frame under a state in which a part of an outer circumferential surface of the photoconductive drum is exposed. The cover is supported on the frame in a manner capable of swinging. In response to an insertion of the photoconductive drum device into the image forming device main body, the cover swings to an opened position so as not to block off a light path an exposure ray irradiated toward the exposed part of the photoconductive drum. In response to a removal of the photoconductive drum device from the image forming device main body, the cover swings to a closed position to cover the exposed part of the photoconductive drum.

20 Claims, 9 Drawing Sheets

PHOTOCONDUCTIVE DRUM DEVICE

BACKGROUND OF THE INVENTION

1. Field of the Invention

The present invention relates to a photoconductive drum device having a frame, a photoconductive drum supported rotatably on the frame under a state in which a part of an outer circumferential surface of the photoconductive drum is exposed, and a cover supported on the frame in a manner capable of swinging for protecting the photoconductive drum.

2. Description of Related Art

An open-and-close cover is provided on a main body of an image forming device such as a copying machine, a facsimile machine and a printer. In a conventional image forming device, after the open-and-close cover is opened and an inner part of the device main body is exposed, a user can carry out maintenance work on a photoconductive drum device or the like provided removably in the device main body. In such a conventional image forming device, the open-and-close cover is provided at an upper part of the device main body. When the open-and-close cover is opened, a process cartridge including a photoconductive drum can be removed from an upper side of the device main body. An openable and closable shutter mechanism for covering an exposed part of the photoconductive drum is provided on the process cartridge to prevent the hand of the user or the like from making contact with the exposed part of the photoconductive drum.

The process cartridge includes a shutter, a supporting member, an elastic member and a force receiving member. The shutter protects the photoconductive drum and is supported by the supporting member. The shutter can move between a protection position and a receded position. At the protection position, the shutter protects the photoconductive drum. The receded position is located at a rear side of the protection position in a direction in which the process cartridge is inserted into the device main body. The elastic member urges the shutter toward the protection position by an elastic force of the elastic member. The force receiving member is provided on the supporting member and is used for inserting the process cartridge into the device main body. The force receiving member makes contact with an edge of an opening provided on an upper surface of the device main body and receives a force to move the shutter backward in the inserting direction against the elastic force of the elastic member. Since the process cartridge has the above-described structure, when the process cartridge is inserted into the device main body, the shutter can be opened automatically, and when the process cartridge is removed, the shutter can be closed automatically.

SUMMARY OF THE INVENTION

According to an aspect of the present invention, even in case of an image forming device having a structure in which a photoconductive drum device including a photoconductive drum is inserted and removed horizontally, when the photoconductive drum device is removed from a device main body, an exposed part of the photoconductive drum can be covered automatically. Therefore, the photoconductive drum can be prevented from being touched accidentally by the hand of a user or the like.

According to an aspect of the present invention, a photoconductive drum device is inserted into and removed from an image forming device main body, horizontally from a side of the image forming device main body. The photoconductive drum device includes a frame, a photoconductive drum and a cover. The photoconductive drum is supported rotatably on the frame under a state in which a part of an outer circumferential surface of the photoconductive drum is exposed. The cover is also supported on the frame in a manner capable of swinging. In response to an insertion movement in which the photoconductive drum device is inserted horizontally into the image forming device main body, the cover swings to an opened position so as not to block off a light path of an exposure ray irradiated toward the exposed part of the photoconductive drum. In response to a removal movement in which the photoconductive drum device is removed horizontally from the image forming device main body, the cover swings to a closed position so as to cover the exposed part of the photoconductive drum.

According to the above aspect of the present invention, when the photoconductive drum device is removed from the image forming device main body, the cover closes automatically and the exposed part of the photoconductive drum is covered. Therefore, the exposed part of the photoconductive drum is prevented from being touched accidentally by the hand of the user or the like. Thus, a maintenance work can be carried out easily.

According to another aspect of the present invention, the image forming device main body includes a rack. A longitudinal direction of the rack is provided toward a direction in which the photoconductive drum device is inserted. A pinion, a gear and a rotational force transmitting device are preferable to be provided on the frame of the photoconductive drum device. The pinion engages with the rack. The gear is provided on a rotational shaft of the cover. The rotational force transmitting device transmits a rotational force from the pinion to the gear.

According to the above aspect of the present invention, when removing the photoconductive drum device from the image forming device main body, a pinion gear is guided by the rack and rotates. A rotational force is transmitted from the pinion gear via the rotational force transmitting device to the gear of the cover. Therefore, the cover closes automatically and the exposed part of the photoconductive drum is prevented from being touched accidentally by the hand of the user or the like.

According to another aspect of the present invention, an urging member is provided between the frame and the cover. When the urging member is located at a position located closer to the photoconductive drum than a dead center (a center of the shaft of the cover), the urging member preferably urges the cover in a direction to close the cover. When the urging member is located at a position located away from the photoconductive drum than the dead center, the urging member preferably urges the cover in a direction to open the cover.

According to the above aspect of the present invention, the cover swung to the opened position is urged by the urging member, and unless a force is applied to the cover to some extent, the cover does not close from the opened position by a weight of the cover. The cover swung to the closed position is urged by the urging member, and unless a force is applied to the cover to some extent, the cover does not open from the closed position by the weight of the cover. Thus, reliability is improved.

According to another aspect of the present invention, a buffer member, which makes contact with the photoconductive drum, is preferable to be provided on a surface of the cover of a side covering the photoconductive drum.

According to the above aspect of the present invention, the cover is prevented from making direct contact with the surface of the photoconductive drum by the buffer member provided on the cover. Therefore, the surface of the photoconductive drum can be prevented from being damaged.

DETAILED DESCRIPTION OF THE INVENTION

Embodiments of the present invention will be described. Further, the embodiments to be described below are preferable specific examples for implementing the present invention. Therefore, there are various technical limitations in the description. However, unless explicitly stated in the following description to limit the present invention, the present invention shall not be limited to the embodiments.

Figure 1:
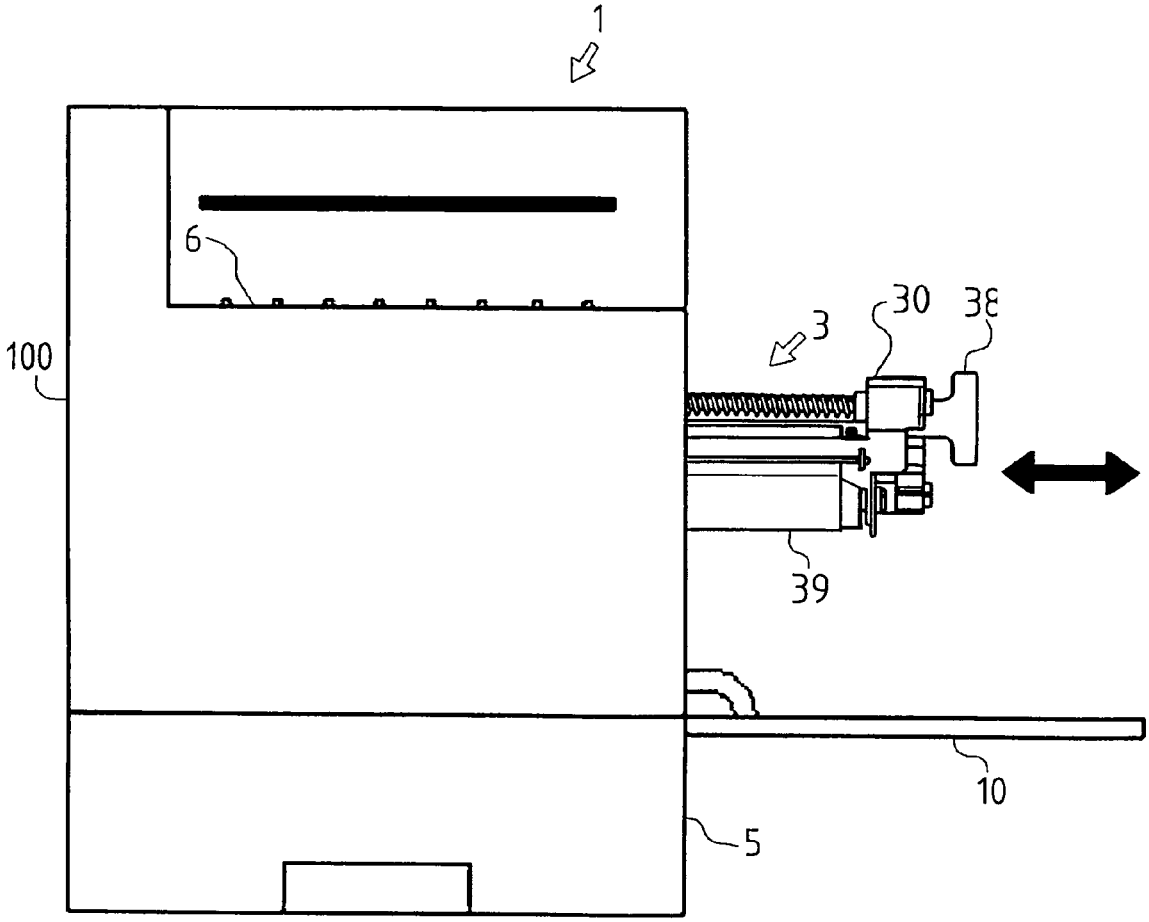
FIG. 1 is a side view showing a schematic structure of an image forming device.
Figure 2:
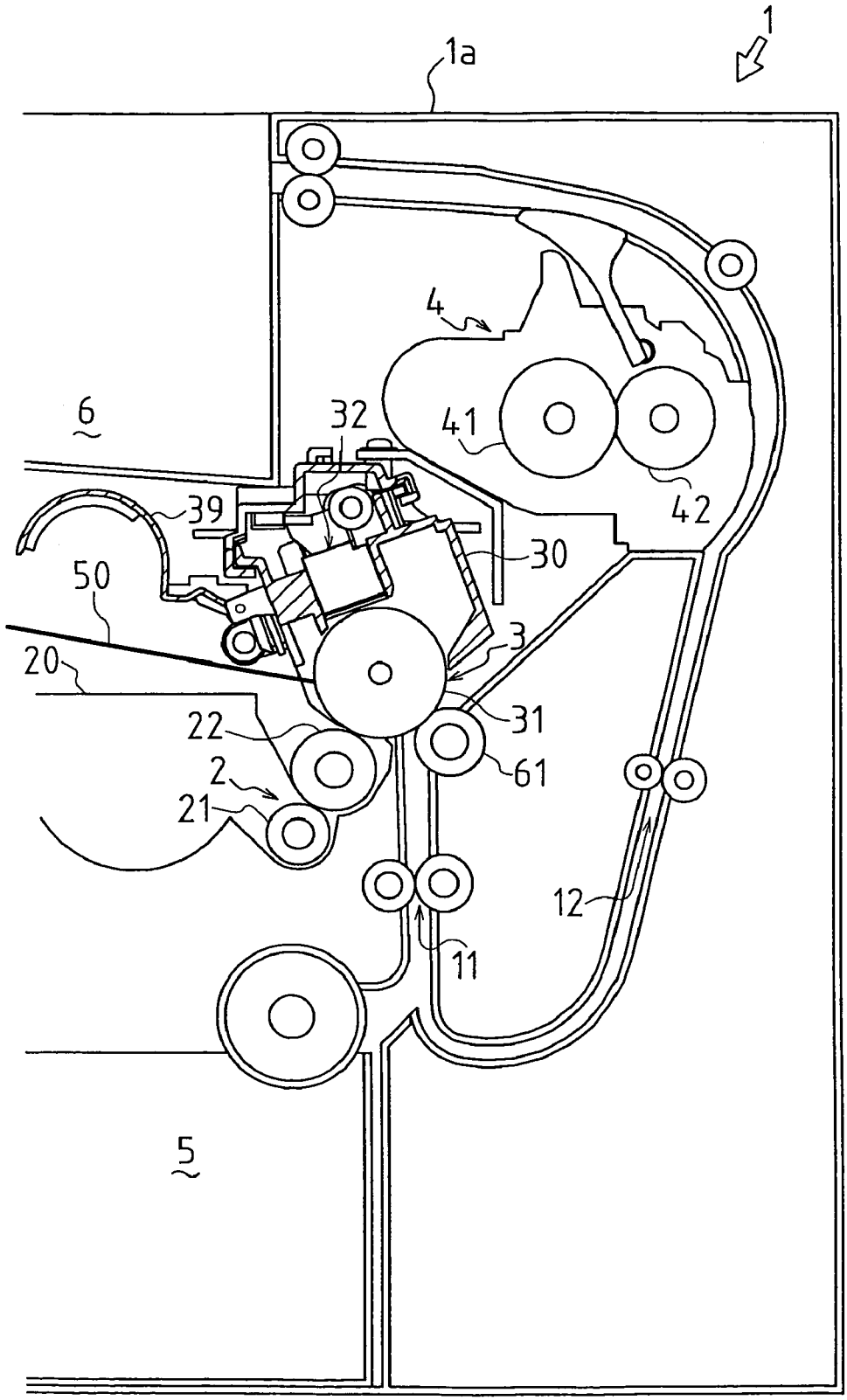
FIG. 2 is a cross-sectional front view showing a schematic structure of the image forming device.

With reference to the drawings, an embodiment of the present invention will be described. First, a description will be given briefly of an image forming device 1 preferably provided in a copying machine, a facsimile machine or the like. As shown in FIG. 1, the image forming device 1 is disposed above a paper feed cassette 5. A paper discharge tray 6 is formed at an upper part of the image forming device 1. As shown in FIG. 2, a main transportation path 11 and a reversal path 12 are formed inside the image forming device 1. The main transportation path 11 is a path for transporting recording paper fed in from the paper feed cassette 5 to the paper discharge tray 6. The reversal path 12 is a path for reversing a front side and a back side of the printing paper. The reversal path 12 is disposed at an outer side of the main transportation path 11. The reversal path 12 starts by diverging from the main transportation path 11 and ends by joining to the main transportation path 11. Along the main transportation path 11, a developing device 2, a photoconductive drum device 3 and a fixing device 4 are disposed toward a downstream side (upward).

The photoconductive drum device 3 includes a photoconductive drum 31 and a charger 32 or the like. As a photoreceptor, the photoconductive drum 31 has a photoconductive layer on an outer circumferential surface. The charger 32 charges the outer circumferential surface of the photoconductive drum 31. When a high voltage is impressed to a discharge wire of the charger 32, a corona discharge is generated. By the corona discharge, a negative electric charge is applied evenly to the outer circumferential surface of the photoconductive drum 31.

An exposing device (not shown) is disposed diagonally above the photoconductive drum 31. The exposing device is a laser scanner unit. The exposing device irradiates an exposure ray 50 in accordance with input image information onto the outer circumferential surface of the photoconductive drum 31 charged by the charger 32. The negative electric charge is eliminated from a part irradiated by the exposure ray 50, and an electrostatic latent image corresponding to the image information is formed on the outer circumferential surface of the photoconductive drum 31.

The developing device 2 includes a supply roller 21 and a developing roller 22 or the like. The supply roller 21 negatively charges toner in a toner case 20, which accommodates the toner, and supplies the negatively charged toner to the developing roller 22. The developing roller 22 supplies the toner to the photoconductive drum 31 on which the electrostatic latent image is formed. By an electrostatic force, the toner is adhered only to the part on the photoconductive drum 31 where the negative electric charge is eliminated.

A transfer roller 61 is disposed across the main transportation path 11 so as to make contact with the outer circumferential surface of the photoconductive drum 31. Printing paper is fed into a nip part between the photoconductive drum 31 and the transfer roller 61. Under this state, when a bias voltage is impressed to the transfer roller 61 from a back side of the printing paper adhered on the photoconductive drum 31, the negatively charged toner is transferred from the photoconductive drum 31 onto the printing paper.

The fixing device 4 includes a heat roller 41 and a press roller 42 which is pressed against an outer circumferential surface of the heat roller 41 across the main transportation path 11. The printing paper is fed into a nip part between the heat roller 41 and the press roller 42. At this time, the printing paper after the transfer is heated and pressured by the heat roller 41 and the press roller 42 and a toner image on the printing paper is fixed.

As described above, the toner image is formed on the printing paper fed from the paper feed cassette 5. After the toner image is fixed by the fixing device 4, the printing paper is discharged onto the paper discharge tray 6.

Referring to FIG. 1 again, an open-and-close cover 10 for a maintenance work is mounted on a front surface side, which is one side of a device main body 100. The open-and-close cover 10 can be swung vertically with a lower position of the device main body 100 as a center. When carrying out maintenance work of the photoconductive drum device 3 or the like accommodated inside the device main body 100, the open-and-close cover 10 is opened and the front surface side of the device main body 100 is opened. Accordingly, an inner part of the device main body 100 is exposed. Further, the photoconductive drum device 3 is inserted into or removed from the device main body 100 in a horizontal direction orthogonal to a direction in which the printing paper is transported (in FIG. 1, in a left-right direction).

Figure 3:
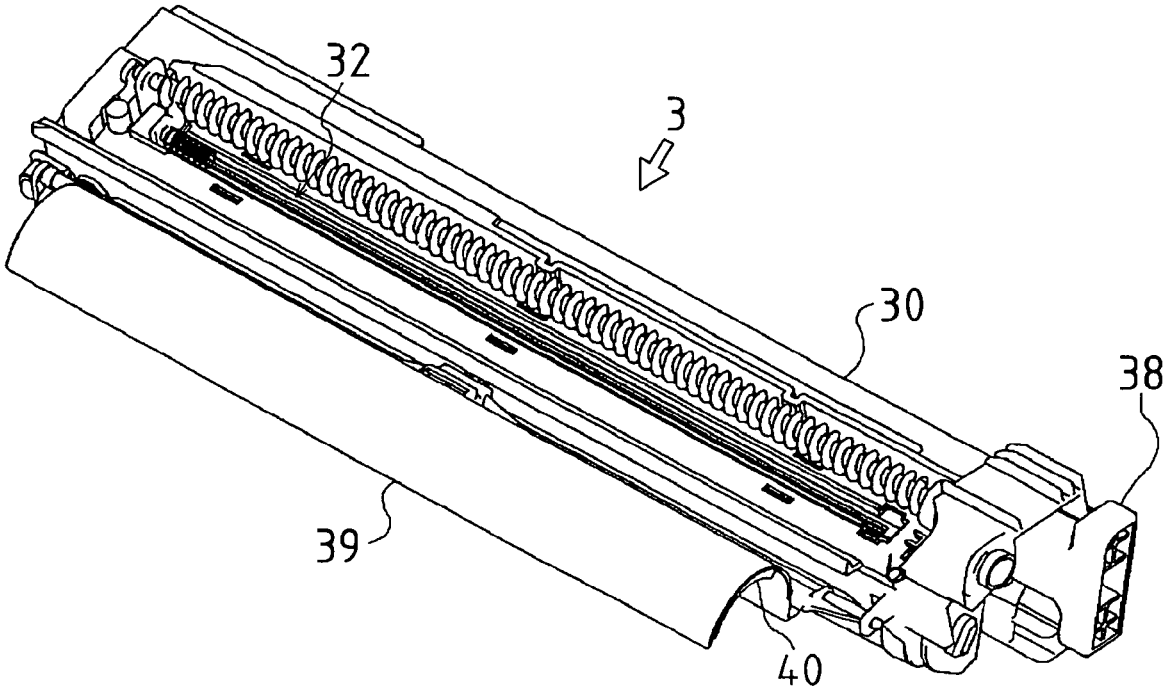
FIG. 3 is a perspective view of a photoconductive drum device.
Figure 4:
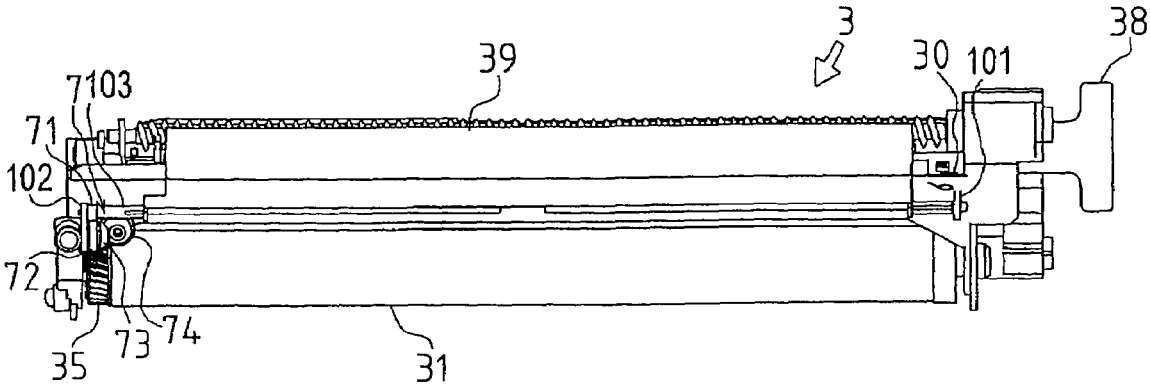
FIG. 4 is a front view of the photoconductive drum device.

Referring to FIGS. 3 and 4, the photoconductive drum device 3 will be described. The photoconductive drum device 3 includes a drum frame 30, the photoconductive drum 31, a drum cover 39 and a gripper 38. The photoconductive drum 31 is supported rotatably at a lower part of the drum frame 30 (at a side of the drum frame 30 located on a side of the transfer roller 61) under a state in which a part (a lower part) of the outer circumferential surface of the photoconductive drum 31 is exposed. The drum cover 39 is also supported on the drum frame 30 in a manner capable of swinging. The gripper 38 is provided at one end of the drum frame 30 in a longitudinal direction. The photoconductive drum device 3 is inserted horizontally into the device main body 100 from another end in the longitudinal direction (from a left side in FIG. 4). A driving gear 35 is provided at the other end of the photoconductive drum 31 in the longitudinal direction. The driving gear 35 engages with a drive transmitting gear of the device main body 100.

As shown in FIG. 2, an opening is formed in the lower part of the drum frame 30 (at the side of the drum frame 30 located on the side of the transfer roller 61). A part of the outer circumferential surface of the photoconductive drum 31 is exposed from the opening. The exposing device irradiates the exposure ray 50 toward the outer circumferential surface of the photoconductive drum 31 exposed from the opening.

Figure 5A:
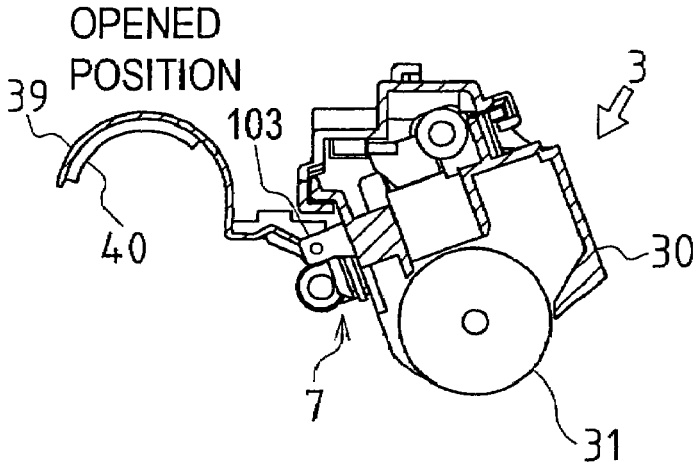
FIGS. 5A through 5C are cross-sectional side views of the photoconductive drum.
Figure 5B:
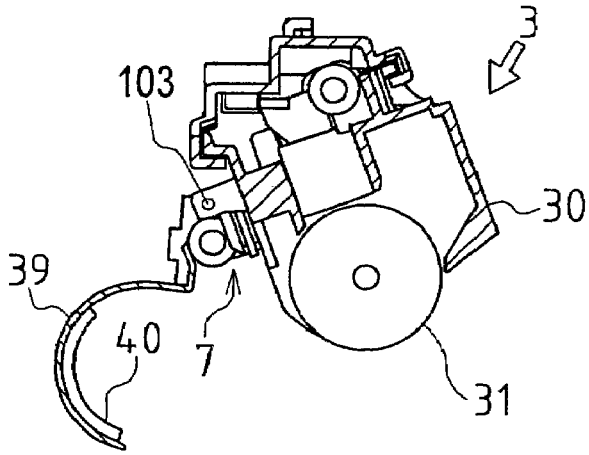
Figure 5C:
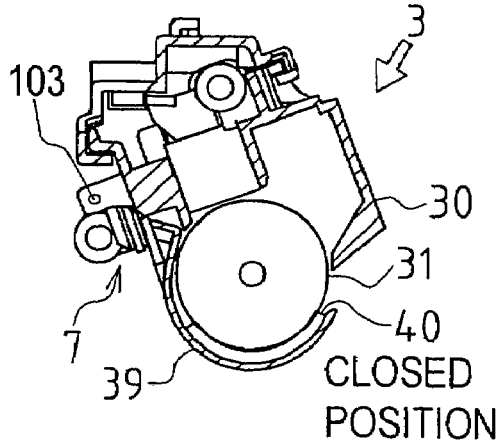

As shown in FIGS. 5A through 5C, the drum cover 39 for covering the opening is mounted on the drum frame 30. The drum cover 39 swings by a mechanical swing device 7 to be described later. Specifically, when the photoconductive drum device 3 is inserted into the device main body 100, in response to the insertion movement, the drum cover 39 swings to an opened position (refer to FIG. 5A) so as not to block off a light path of the exposure ray 50. Meanwhile, when the photoconductive drum device 3 is removed from the device main body 100, in response to the removal movement, the drum cover 39 swings to a closed position (refer to FIG. 5C) so as to cover the exposed part of the photoconductive drum 31.

At least one buffer member 40 is mounted on a surface of the drum cover 39 of a side covering the photoconductive drum 31. When the drum cover 39 is closed, the buffer member 40 makes contact with the photoconductive drum 31. The buffer member 40 is a sponge or the like, and is adhered on the surface of the drum cover 39 of the side covering the photoconductive drum 31. The drum cover 39 is prevented from making direct contact with the surface (the outer circumferential surface) of the photoconductive drum 31 by the buffer member 40. As a result, the surface of the photoconductive drum 31 is prevented from being damaged.

Further, in the present embodiment, the buffer member 40 is provided at both ends of the drum cover 39 in the longitudinal direction. However, the buffer member 40 can be provided at three positions, for example, at both ends and at a center part of the drum cover 39 in the longitudinal direction. Alternatively, the buffer member 40 can be provided over the entire surface of the drum cover 39 at the side covering the photoconductive drum 31.

Next, the mechanical swing device 7 for swinging the drum cover 39 will be described. As shown in FIG. 4, brackets 101 and 102 extending downward are formed at both ends of the drum frame 30 in the longitudinal direction. A rotational shaft 103 of the drum cover 39 is supported rotatably by the brackets 101 and 102.

Figure 6:
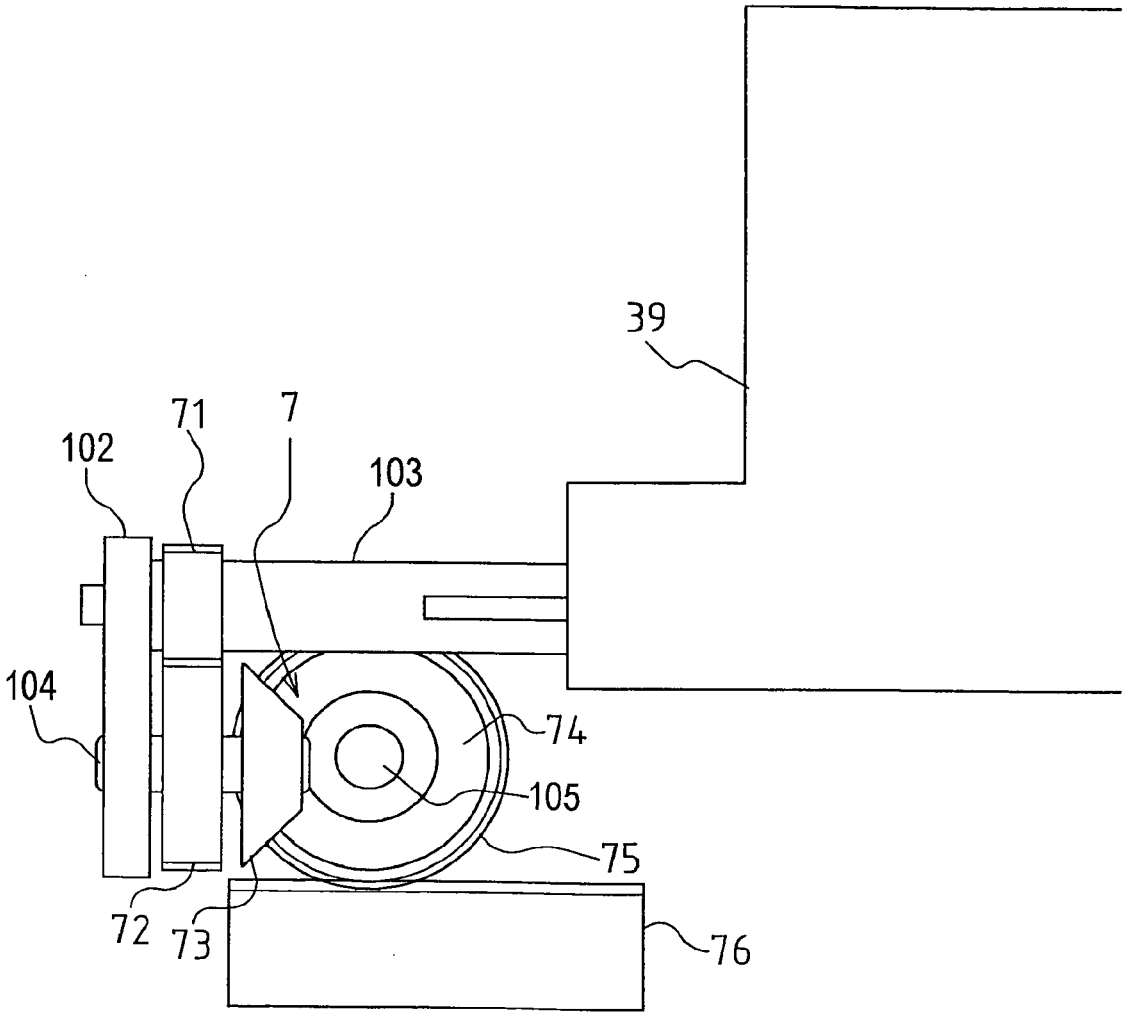
FIG. 6 is a plan view of a mechanical swing device.
Figure 7:
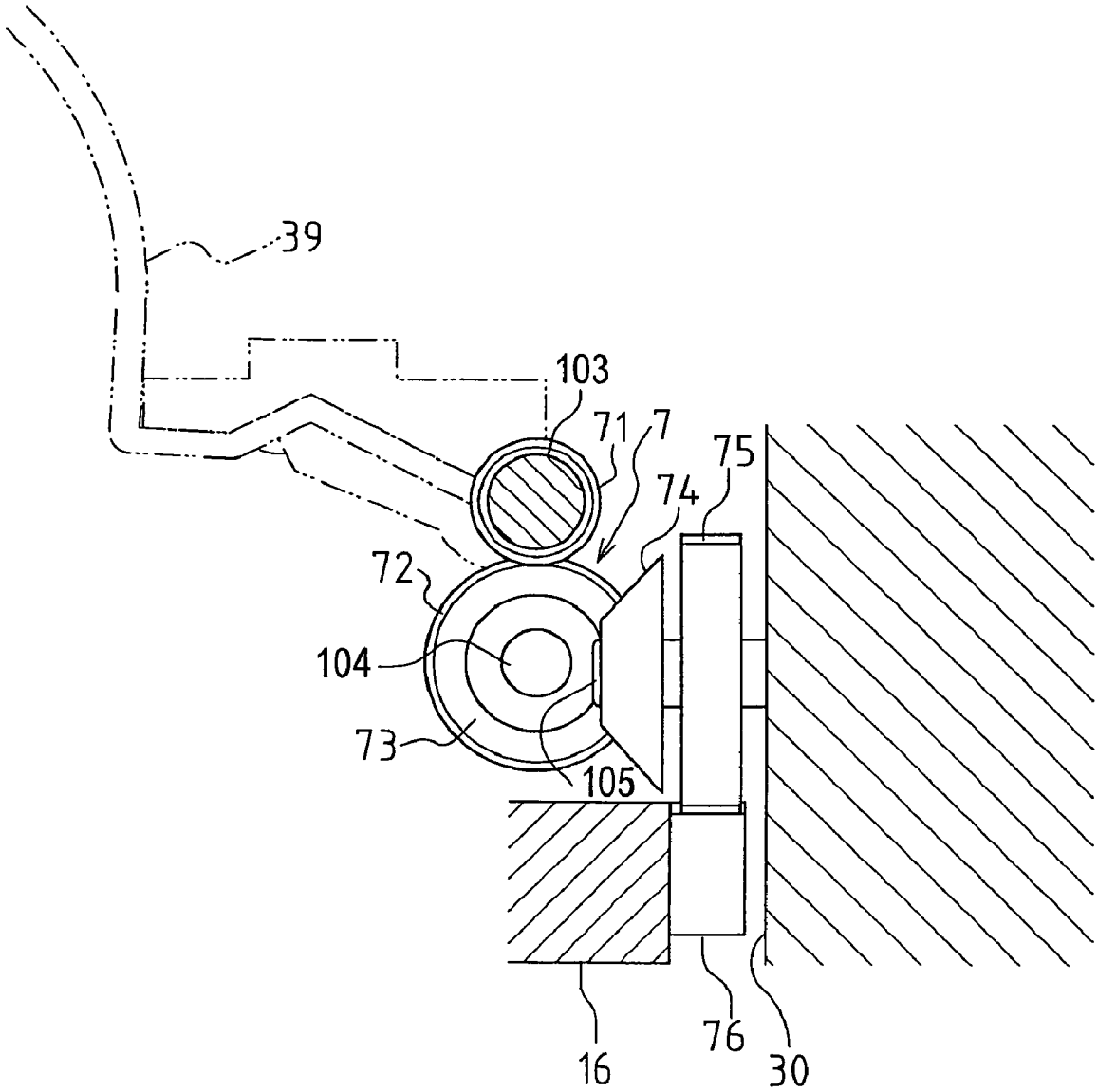
FIG. 7 is a side view of the mechanical swing device.

As shown in FIGS. 6 and 7, a first spur gear 71 is fixed on the other end of the rotational shaft 103 of the drum cover 39 in the longitudinal direction. A second spur gear 72, which engages with the first spur gear 71, is supported rotatably by the bracket 102 at the other end of the drum frame 30 in the longitudinal direction (at left in FIG. 6). A rotational shaft 104 of the second spur gear 72 is disposed in parallel with the rotational shaft 103 of the drum cover 39. The rotational shaft 104 is held only by the bracket 102.

A first bevel gear 73 is fixed on an end part of the rotational shaft 104 of the second spur gear 72. At the other end of the drum frame 30 in the longitudinal direction, a second bevel gear 74, which engages with the first bevel gear 73, is provided rotatably. A rotational shaft 105 of the second bevel gear 74 is disposed in a direction orthogonal to the rotational shaft 104 of the first bevel gear 73. The first bevel gear 73 and the second bevel gear 74 constitute a rotational direction converting device. The rotational direction converting device converts a rotation of a gear around a shaft orthogonal to the insertion direction of the photoconductive drum device 3 into a rotation of a gear around a shaft parallel to the insertion direction.

A pinion gear 75 is fixed on the rotational shaft 105 of the second bevel gear 74. A rack 76 is provided in the device main body 100. The rack 76 engages with the pinion gear 75. The rack 76 is disposed at an inner side of an accommodation space where the photoconductive drum device 3 is accommodated. The rack 76 is mounted in the device main body 100 via a bracket 16. A longitudinal direction of the rack 76 is the same as the insertion direction of the photoconductive drum device 3. The length of the rack 76 in the longitudinal direction is designed to be a length necessary for the drum cover 39 to swing between the opened position and the closed position when the pinion gear 75 is guided from one end to another end of the rack 76 in the longitudinal direction.

The above-described mechanical swing device 7 for swinging the drum cover 39 is formed with the gears 71 through 74, the pinion gear 75 and the rack 76. A rotational force transmitting device for transmitting a rotational force from the pinion gear 75 to the first spur gear 71 is formed with the gears 72 and 73.

Figure 8:
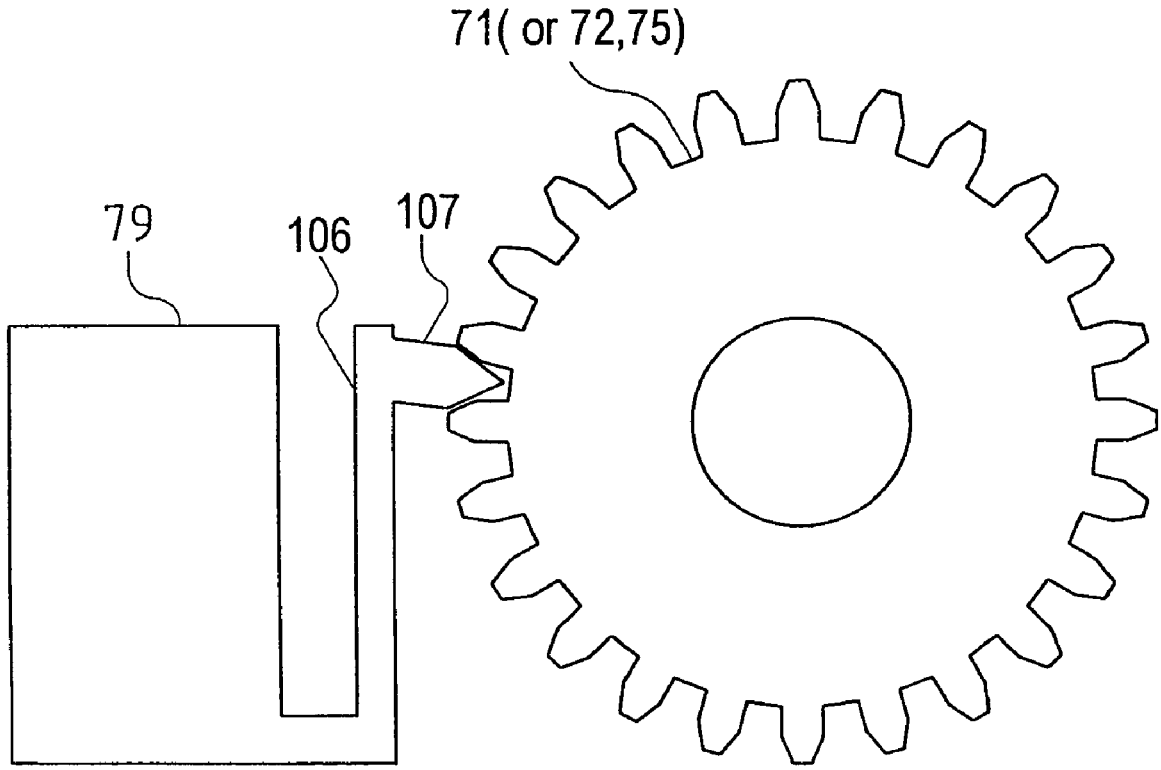
FIG. 8 is a plan view of a gear having a locking member.

As shown in FIG. 8, a locking member 79 is provided at the drum frame 30 located immediately next to at least one gear among the first spur gear 71, the second spur gear 72 and the pinion gear 75. The locking member 79 includes an arm portion 106 and a craw portion 107. The arm portion 106 can be transformed elastically in a direction to approach and separate with respect to the gear 71 (or 72 or 75). The craw portion 107 is provided protruding from a tip end of the arm portion 106 toward the gear. The craw portion 107 enters into a space between adjacent teeth of the gear 71 (or 72 or 75).

Therefore, since the rotation of the gear 71 (or 72 or 75) is regulated by the locking member 79, a transmission of the rotational force by the mechanical swing device 7 is regulated. Thus, unless a force is applied to the mechanical swing device 7 to some extent, the drum cover 39 does not close unintentionally by the weight of the drum cover 39.

Figure 9:
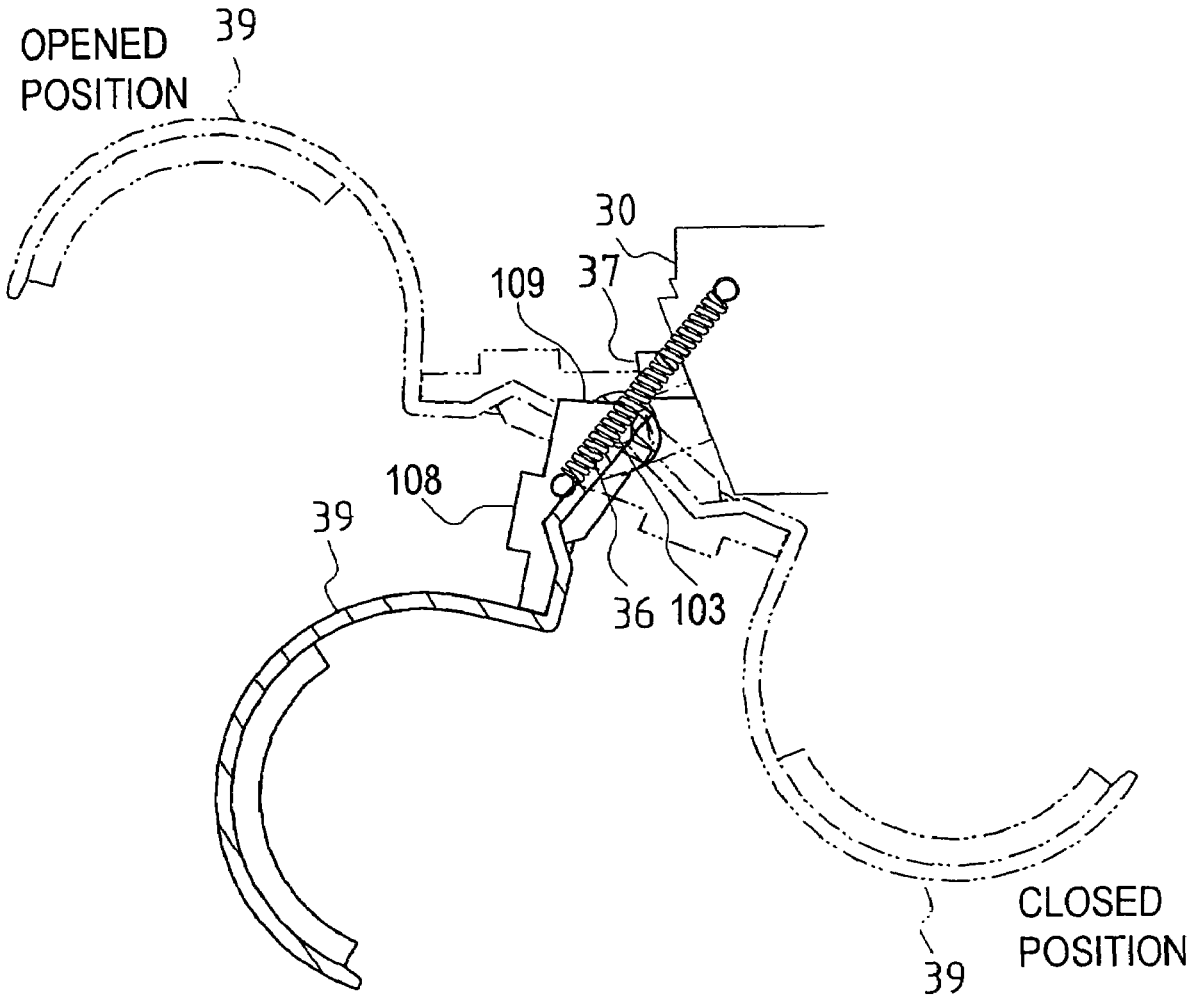
FIG. 9 is a cross-sectional side view showing a drum cover and a coil spring.

As shown in FIG. 9, a coil spring 36 as an urging device is mounted between the drum frame 30 and the drum cover 39. When the coil spring 36 is located at a position closer to the photoconductive drum 31 than the rotational shaft 103 of the drum cover 39 (dead center), the coil spring 36 urges the drum cover 39 in a direction to close the drum cover 39. When the coil spring 36 is located at a position located further away from the photoconductive drum 31 than the rotational shaft 103 of the drum cover 39, the coil spring 36 urges the drum cover 39 in a direction to open the drum cover 39. A stopper member 37 is formed protruding from a side of the drum frame 30 toward the drum cover 39. Therefore, when the drum cover 39 is swung to the opened position by the coil spring 36, an end part 109 of a base part 108 of the drum cover 39 makes contact with the stopper member 37 and the drum cover 39 is prevented from swinging any further beyond the opened position.

When the drum cover 39 is swung to the closed position by the coil spring 36, the buffer member 40 makes contact with the outer circumferential surface of the photoconductive drum 31 (refer to FIG. 5C), and the drum cover 39 is prevented from swinging further toward the photoconductive drum 31.

Further, a second stopper member can be provided on a side of the drum frame 30 at a side of the drum cover 39. Accordingly, when the drum cover 39 is swung to the closed position, another end of the base part 108 of the drum cover 39 makes contact with the second stopper member and the drum cover 39 is prevented from swinging further toward the photoconductive drum 31.

As described above, the drum cover 39 swung to the opened position (or the closed position) is urged by the coil spring 36, which is an urging device. Therefore, unless a force is applied to the drum cover 39 to some extent, the drum cover 39 does not close from the opened position (or open from the closed position) unintentionally by the weight of the drum cover 39. Thus, reliability is improved.

Next, an automatic opening and closing of the drum cover 39 will be described. As shown in FIG. 1, under a state in which the drum cover 39 is located at the closed position, the user inserts the photoconductive drum device 3 horizontally into the accommodation space in the device main body 100. When the photoconductive drum device 3 is inserted into the accommodation space in the device main body 100, immediately before the photoconductive drum device 3 is inserted completely, the rack 76 of the device main body 100 and the pinion gear 75 of the drum frame 30 start to be engaged with one another.

At this time, the gear 71 (or 72 or 75) is locked by the locking member 79 and the drum cover 39 is urged by the coil spring 36. Therefore, a force is required to some extent to push in (or pull out) the photoconductive drum device 3.

When the user continues to push in the photoconductive drum device 3, the pinion gear 75 is guided by the rack 76 and rotates. Accordingly, a rotational force is transmitted sequentially to the pinion gear 75, the second bevel gear 74, the first bevel gear 73, the second spur gear 72 and the first spur gear 71. As a result, the drum cover 39 located at the closed position swings from the state shown in FIG. 5C via a state shown in FIG. 5B to the state shown in FIG. 5A. As described above, the drum cover 39 swings in response to the insertion movement of the photoconductive drum device 3 into the device main body 100 and is held at the opened position so as not to block of f the light path of the exposure ray 50 irradiated toward the exposed part of the photoconductive drum 31.

When removing the photoconductive drum device 3 from the device main body 100, immediately after the photoconductive drum device 3 starts to be removed, the pinion gear 75 at the drum frame 30 starts to be guided by the rack 76 at the device main body 100. When the user pulls out the photoconductive drum device 3 with a force to some extent or more, the pinion gear 75 is guided by the rack 76 and rotates. Accordingly, a rotational force is transmitted to the pinion gear 75, the second bevel gear 74, the first bevel gear 73, the second spur gear 72 and the first spur gear 71. As a result, the drum cover 39 located at the opened position swings from the state shown in FIG. 5A via the state shown in FIG. 5B to the state shown in FIG. 5C. As described above, the drum cover 39 swings in response to the removal movement of the photoconductive drum device 3 from the device main body 100 and is held at the closed position to protect the exposed part of the photoconductive drum 31.

As described above, according to an aspect of the present invention, when the photoconductive drum device 3 is removed from the device main body 100, the drum cover 39 closes automatically and the exposed part of the photoconductive drum 31 is covered. As a result, the exposed part of the photoconductive drum 31 is prevented from being touched by the hand of the user or the like. Since the photoconductive drum 31 is located in the lower part of the photoconductive drum device 3, the user finds it difficult to visually confirm the photoconductive drum 31 when removing the photoconductive drum device 3. Conventionally, there are drawbacks that the user accidentally touches the surface of the photoconductive drum 31 and the toner adheres to the hand of the user. However, according to the present invention, such drawbacks are resolved and maintenance work can be carried out easily.

The invention claimed is:

1. A photoconductive drum device, comprising:

a frame;

a photoconductive drum which is supported rotatably on the frame under a state in which a part of an outer circumferential surface of the photoconductive drum is exposed; and a cover which is supported on the frame in a manner capable of swinging;

wherein the photoconductive drum device is inserted into and removed from an image forming device main body, horizontally from one side of the image forming device main body;

in conjunction with an insertion of the photoconductive drum device into the image forming device main body, the cover swings to an opened position so as not to block off a light path of an exposure ray irradiated toward the exposed part of the photoconductive drum; and in conjunction with a removal of the photoconductive drum device from the image forming device main body, the cover swings to a closed position so as to cover the exposed part of the photoconductive drum.

2. The photoconductive drum device according to claim 1, further comprising a part of a mechanical swing device which swings the cover.

3. The photoconductive drum device according to claim 2, wherein the part of the mechanical swing device includes a pinion provided on the frame, a gear provided on a rotational shaft of the cover and a rotational force transmitting device which is provided on the frame and transmits a rotational force from the pinion to the gear.

4. The photoconductive drum device according to claim 2, wherein the part of the mechanical swing device includes a rotational direction converting device which changes a rotation around a shaft orthogonal to an insertion direction of the photoconductive drum device into a rotation around a shaft parallel to the insertion direction of the photoconductive drum device.

5. The photoconductive drum device according to claim 2, further comprising a locking member which regulates a rotation of a gear of the part of the mechanical swing device.

6. The photoconductive drum device according to claim 1, further comprising an urging member which is mounted between the frame and the cover;

wherein when the urging member is located at a position closer to the photoconductive drum than a shaft center of the cover, the urging member urges the cover in a direction to close the cover, and when the urging member is located at a position located further away from the photoconductive drum than the shaft center, the urging member urges the cover in a direction to open the cover.

7. The photoconductive drum device according to claim 6, further comprising a stopper member which stops a further swing of the cover swung to the opened position by the urging member.

8. The photoconductive drum device according to claim 1, further comprising a buffer member which is provided on a surface of the cover of a side covering the photoconductive drum and makes contact with the photoconductive drum.

9. The photoconductive drum device according to claim 8, wherein the buffer member is a sponge.

10. An image forming device, comprising:

an image forming device main body; and a photoconductive drum device which is inserted into and removed from the image forming device main body, horizontally from one side of the image forming device main body;

wherein the photoconductive drum comprises:

a frame;

a photoconductive drum which is supported rotatably on the frame under a state in which a part of an outer circumferential surface of the photoconductive drum is exposed; and a cover which is supported on the frame in a manner capable of swinging;

wherein in conjunction with an insertion of the photoconductive drum device into the image forming device main body, the cover swings to an opened position so as not to block off a light path of an exposure ray irradiated toward the exposed part of the photoconductive drum; and in conjunction with a removal of the photoconductive drum device from the image forming device main body, the cover swings to a closed position so as to cover the exposed part of the photoconductive drum.

11. The image forming device according to claim 10, further comprising a mechanical swing device which swings the cover.

12. The image forming device according to claim 11, wherein the mechanical swing device comprises:

a rack which is provided in the image forming device main body and which a longitudinal direction of the rack is parallel to an insertion direction of the photoconductive drum device;

a pinion which is provided on the frame of the photoconductive drum device;

a gear which is provided on a rotational shaft of the cover; and a rotational force transmitting device which is provided on the frame and transmits a rotational force from the pinion to the gear.

13. The image forming device according to claim 12, wherein the mechanical swing device includes a rotational direction converting device which changes a rotation around a shaft orthogonal to the insertion direction of the photoconductive drum device to a rotation around a shaft parallel to the insertion direction of the photoconductive drum device.

14. The image forming device according to claim 11, further comprising a locking member which regulates a rotation of a gear of the mechanical swing device.

15. The image forming device according to claim 10, further comprising an urging member which is mounted between the frame and the cover, wherein when the urging member is located at a position closer to the photoconductive drum than a shaft center of the cover, the urging member urges the cover in a direction to close the cover, and when the urging member is located at a position located further away from the photoconductive drum than the shaft center, the urging member urges the cover in a direction to open the cover.

16. The image forming device according to claim 15, further comprising a stopper member which stops a further swing of the cover swung to the opened position by the urging member.

17. The image forming device according to claim 10, further comprising a buffer member which is provided on a surface of the cover of a side covering the photoconductive drum and makes contact with the photoconductive drum.

18. The image forming device according to claim 17, wherein the buffer member is a sponge.

19. A method for manufacturing an image forming device, comprising:

providing a frame;

supporting a photoconductive drum rotatably on the frame under a state in which a part of an outer circumferential surface of the photoconductive drum is exposed;

supporting a cover on the frame in a manner capable of swinging; and inserting and removing the photoconductive drum device into and from an image forming device main body, horizontally from one side of the image forming device main body such that in conjunction with an insertion of the photoconductive drum device into the image forming device main body, the cover swings to an opened position so as not to block off a light path of an exposure ray irradiated toward the exposed part of the photoconductive drum and in conjunction with a removal of the photoconductive drum device from the image forming device main body, the cover swings to a closed position so as to cover the exposed part of the photoconductive drum.

20. The method for manufacturing an image forming device according to claim 19 further comprising providing a part of a mechanical swing device which swings the cover.

* * * * *